US005920923A

United States Patent [19]

Jillette

[11] Patent Number: 5,920,923

[45] Date of Patent: Jul. 13, 1999

[54] HYDRO-THERAPEUTIC STIMULATOR

[76] Inventor: Penn Jillette, Buggs & Rudy, 3555 W. Reno, Suite L, Las Vegas, Nev. 89118

[21] Appl. No.: 09/005,258

[22] Filed: Jan. 9, 1998

[51] Int. Cl.[6] ..... A47K 3/00

[52] U.S. Cl. ..... 4/541.1; 4/541.3; 4/541.6

[58] Field of Search ..... 4/541.1, 541.2, 4/541.3, 541.4, 541.5, 541.6

[56] References Cited

U.S. PATENT DOCUMENTS

| | | | |
|---|---|---|---|
| 3,902,200 | 9/1975 | Pratt . | |
| 4,123,808 | 11/1978 | Guarrera | 4/7 |
| 5,236,581 | 8/1993 | Perry | 4/541.1 |
| 5,267,359 | 12/1993 | Clark . | |
| 5,418,984 | 5/1995 | Livingston, Jr. | 4/541.1 |
| 5,459,887 | 10/1995 | Roman et al. | 4/541.2 |
| 5,682,625 | 11/1997 | Leaverton et al. | 4/541.1 |
| 5,754,989 | 5/1998 | Ludlow | 4/541.6 |

*Primary Examiner*—David J. Walczak
*Attorney, Agent, or Firm*—Scott L. Sullivan

[57] ABSTRACT

A spa of a type including a tub for holding water and a user, in particular, a female user. The spa has a seat for supporting the female user in a seated position, a circulation pump having an inlet connected to the tub for drawing water from the tub, and an outlet connected to the tub for discharging the drawn water back to the tub. A discharge nozzle is located within the tub and connected to the outlet, mounted to the seat so that the discharged water from the circulation pump automatically aligns with and is directed to stimulation points (e.g., the clitoris) of the female user when the female user sits in the seat.

7 Claims, 2 Drawing Sheets

HYDRO-THERAPEUTIC STIMULATOR

BACKGROUND OF THE INVENTION a) Field of the Invention

This invention generally relates to hydro-therapeutic devices, such as spas, hot tubs and whirlpools, and more particularly, to such devices that use an aerated stream of water to stimulate specific areas of a body.

b) Background of the Prior Art

Many different therapeutic devices and structures are known in the prior art that discharge water against and around a human body to stimulate and massage the user's muscles. Such devices include hand-held sprayers which may be attached to conventional bath tub faucets or to a shower head and which are designed to direct a controlled, sometimes pulsating stream of water to selected areas of the user's body. Other devices include larger and more dedicated systems, such as spas, hot tubs, and whirlpools (collectively referred hereinafter as "spas") which provide a more general hydro-therapy to the entire body of the user.

Early spas were therapeutic facilities, usually large public pools whose water was heated and made to circulate (the earliest spas were natural springs, some of which having a source of water that was geothermally heated). With the availability of suitable plastic materials and small reliable heaters and water pumps, relatively low cost personal-use (accommodating 1–5 people) spas became commercially viable and quite popular.

Early personal-use spas included simple means to provide general circulation and filtration of the heated spa water. As the spas advanced, the simple circulation system was modified to return a portion of the circulating water to the spa in jet outlets that produced a strong stream of water at predetermined points throughout the spa.

The jet outlets of these prior art spas were located throughout the spa so that the spa users could position themselves to receive a forced, massaging stream of water against their bodies. In a further innovation, air was entrained into the returning water stream to increase water turbulence and further stimulate and massage the users' bodies. Although the aerated stream of fluid forced from each jet outlet located within such spas provides a massaging effect to the user, the actual parts of the user's body that the forced fluid from these jet outlets is capable of reaching is quite limited. The limited number of jet outlets are typically located along the walls of the spa and generally provide a single jet outlet for each person within the spa. The location of a typical jet outlet of a prior art spa is such that a user seated within the spa may focus the forced fluid to any point between the shoulders and mid-back. Without undue contortion of the user's body or standing up in the spa, all other parts of the user's body are not reachable using any of the wall jets. These are only mildly massaged by the general circulation, aeration and elevated temperature of the water.

U.S. Pat. No. 5,418,984, issued to Livingston, Jr. and U.S. Pat. No. 5,267,359, issued to Clark both disclose spas having integrally-formed seats for supporting the spa users. In both of these patents, outlet jets are located within the seat structure so that several streams of fluid are generally directed to lower back and underside of the user's body.

U.S. Pat. No. 5,418,984 discloses a spa-seat structure that includes several fluid outlets that only provide general stimulation over a large area of a user's lower back and underside.

U.S. Pat. No. 5,267,359 discloses a spa having a seat with outlet jets which are generally arranged. Such non-specific positioning of the outlet jets throughout the seat structure will merely provide a general overall massaging and mild stimulation to a users body over a broad area.

Other related devices which would direct a stream of water (heated or otherwise) to a human body include bidets, and sitz baths. A bidet is a device that is used to direct a controlled stream (or spray) of heated water to the rectum and adjacent area of a user in an effort to clean the general area prior to or in place of using toilet tissue. The bidet may be incorporated with a conventional toilet wherein a stream of water is provided by an appropriately directed nozzle, or may be provided as a separate bathroom fixture (usually positioned immediately adjacent to a conventional toilet). In the later device, a substantially vertical stream of heated water is directed upwardly. A squatting user may position himself with respect to the stream to direct the water against the area in need of cleaning.

A sitz bath is a device for providing a circulating flow of heated or otherwise treated water (or other fluid) around the lower abdomen of a user. The device is essentially a small bath tub into which only a small portion of the user's body may fit, usually his or her midsection. A sitz bath typically includes an integral seat which supports the user in such a manner that allows his or her midsection to be submerged in the circulating water. The circulating water is constantly replaced with clean water and is generally used to treat a patient's rectal area.

Although both bidets and sitz baths may inherently massage a particular area of a user's body, they are designed and used to clean a specific area of the body, usually the rectum of either a female or a male, and possibly the vagina and surrounding area of the female body.

An example of a typical sitz bath is disclosed in U.S. Pat. No. 3,902,200 issued to Pratt. This device includes a portable seat which supports the user's lower abdomen. The device has an inlet hose that is connected to a faucet of a conventional tub and attached to the seat structure so that a stream of water may be directed to the rectum area of the user. U.S. Pat. No. 3,902,200, in its entirety is herein incorporated by reference.

A portable bidet-like device is disclosed in U.S. Pat. No. 4,123,808 issued to Guarrera. Here, a female user is positioned within a conventional bath tub on a seat structure that allows her to spread her legs sufficiently to separate her labia and expose her vagina. The device includes an outlet nozzle that is connected to a water supply and positioned on the floor of the bath tub to provide an upwardly directed spray of water. The volume or intensity of the water spray is controlled by a foot-operated valve. The spray of water is intended to be directed at the female user's labia, vagina, and rectum for the purpose of cleaning the same. U.S. Pat. No. 4,123,808, in its entirety is herein incorporated by reference.

Applicant has recognized a need for a hydro-therapeutic device that provides a dedicated stream of fluid to specifically stimulate the clitoris and labia of a female's vulva and provide supporting structure that allows the female user to comfortably position herself with respect to the fluid stream. Although sitz baths, bidets, spas, hot tubs, and whirlpools, described above, may inherently provide some stimulation to a user, they are neither designed nor intended to direct a dedicated stream of water to specific sensitive (sexually-stimulating) areas of a woman's vulva for the main purpose of providing genitalia stimulation.

Furthermore, since the purpose of the above-described prior art bidets and sitz baths are to clean specific recto-genital regions of the user's body, they provide a light-force, diverged spray of fluid. Although this diverged spray may provide some stimulation to the overall recto-genital region, this stimulation is inherently week because the flow of the fluid is not provided as a concentrated stream directed to the specific highly sensitive areas of the female user's genitalia, i.e., the clitoris and the surrounded labia.

It is therefore an object of the present invention to provide a spa that includes a dedicated stream of fluid that is directed to specific sensitive areas of a female's genitalia to promote pleasurable (and perhaps climatic) genitalia stimulation and therapeutic relaxation.

It is another object of the invention to provide such a device that is formed integrally within a seat located within the spa.

It is yet another object of the present invention to provide a device that directs a stream of fluid to specific sensory areas of a female's genitalia to promote pleasurable genitalia stimulation and therapeutic relaxation without substantial stimulation to immediately adjacent less-sensitive areas.

It is yet another object of the invention to provide such a hydro-therapeutic stimulation device that overcomes the deficiencies of the prior art.

SUMMARY OF THE INVENTION

A spa of a type including a tub for holding water and a user, in particular, a female user. According to the invention, the spa has a seat for supporting the female user in a seated position, a circulation pump having an inlet connected to the tub for drawing water from the tub, and an outlet connected to the tub for discharging the drawn water back to the tub. A discharge nozzle is located within the tub and connected to the outlet, mounted to the seat so that the discharged water from the circulation pump automatically aligns with and is directed to stimulation points (e.g., the clitoris) of the female user when the female user sits in the seat.

DETAILED DESCRIPTION OF THE PREFERRED EMBODIMENTS

Figure 1:
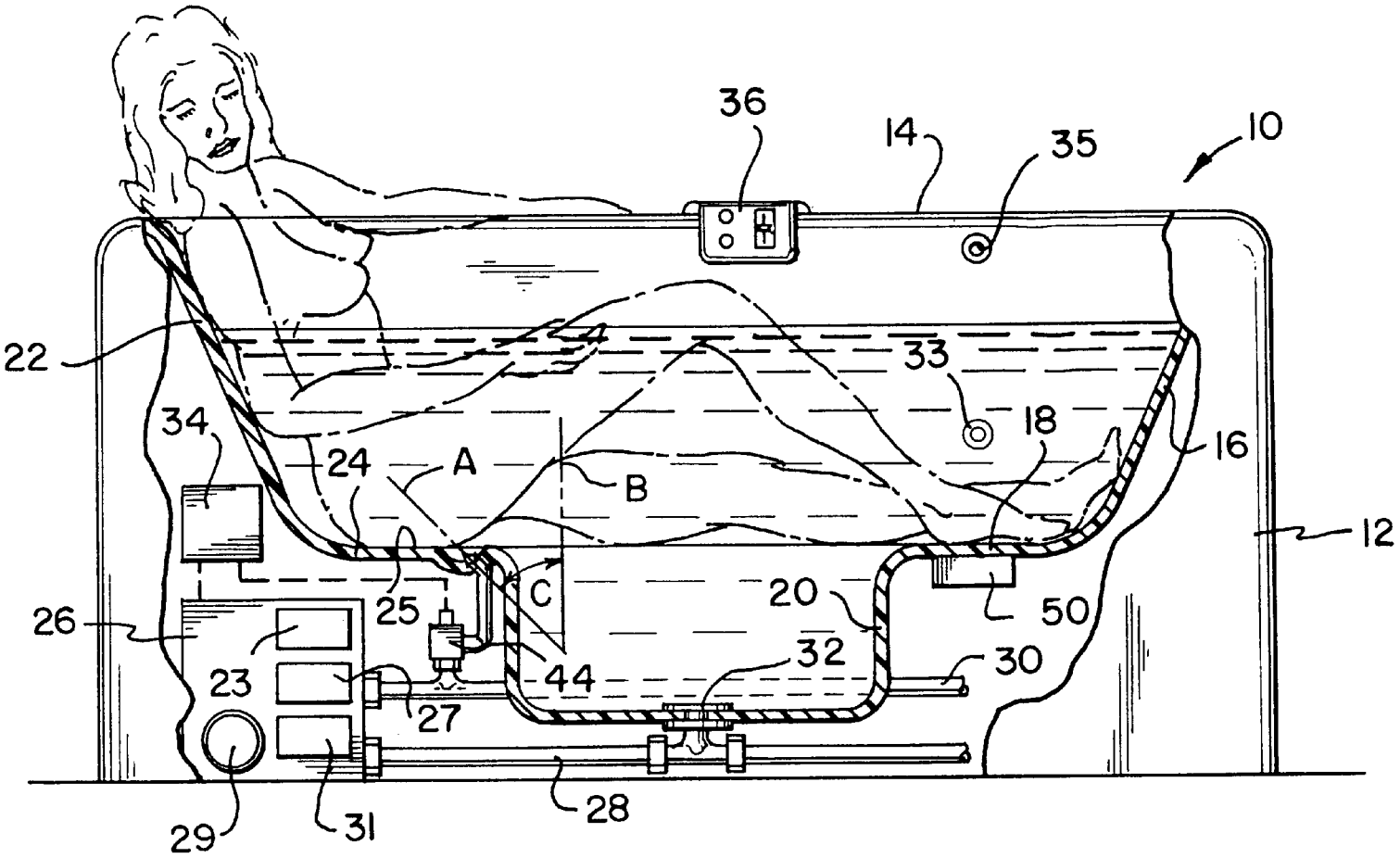
FIG. 1 is a partially-sectional side view of a spa bath showing details of a clitoris-stimulating water jet assembly, according the invention.

Referring to FIG. 1, a spa 10 is shown, according to the invention, having a tub 12 defining an upper rim 14. Tub 12 includes sidewalls 16, a floor 18, and may include a foot well 20 (foot well 20 is preferable but is not required to carry out the present invention). Sidewalls 16 and floor 18 are preferably sized and shaped to function as a seat to provide comfortable reclined support to at least one person located within tub 12. The integrally formed seat is formed by a slanted backrest 22 that is formed within the structure of sidewall 16, and a base 24 that is formed within the structure of floor 18. Base 24 includes an upper supporting surface 25, that although shown generally flat, may be formed somewhat bowl-shaped to conform to the generally shape of the user's butt and thereby allow the user to recline back against backrest 22 without slipping off the seat and into foot well 20.

As is understood by those skilled in the art, spa 10 further includes a water-flow controlling assembly 26 which includes a filtration assembly 27, a water pump 29, a water heater 31 and aerator assembly 23. Water-flow controller 26 includes an inlet pipe 28 and an outlet pipe 30. Inlet pipe 28 is connected to tub 12 at a drain 32, in this case, located within foot well 20 so that water located within tub 12 may pass through pipe 28 and into water-flow controller 26, as described in greater detail below.

Outlet pipe 30 is connected between water-flow controller 26 and tub 12 and is used to return filtered and aerated water to tub 12. Outlet pipe 30 is connected to wall-mounted jets 33 (direct connection not shown), as is understood by those skilled in the art, so that water may discharge from wall jets 33 and circulate throughout water in tub 12. Air inlet ports 35 are located along walls 16 of tub 12, usually along rim 14 above the waterline of the water in tub 12.

A system controller 34, including a remote control panel 36, is electrically connected to water-flow controller 26 and functions as a controlling interface between the user and water-flow controller 26. System controller 34 allows the user to control the various subsystems of water-flow controller 26. For example, the user may operate control panel 36 to control the temperature of the water, or the degree of water circulation within tub 12, or the amount of bubbles entrained within the water located within tub 12.

Figure 2:
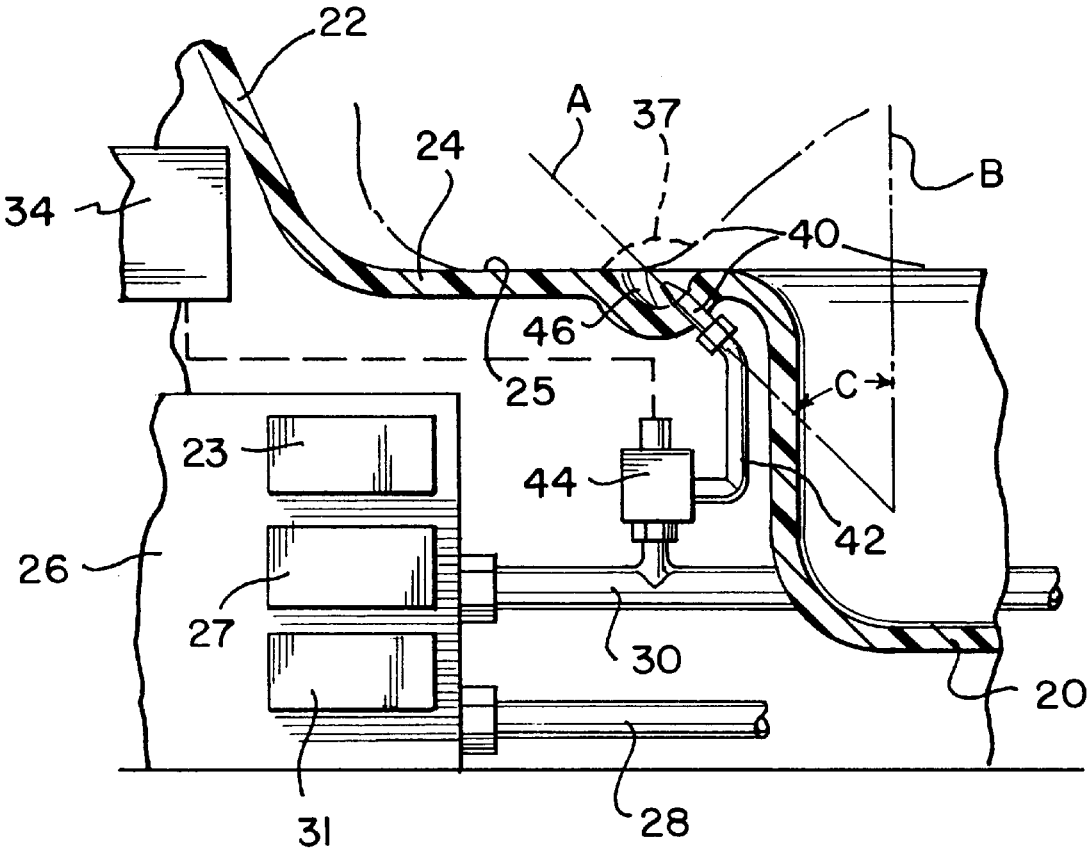
FIG. 2 is an enlarged partial view of the spa of FIG. 1, according to the invention, showing details of the clitoris-stimulating water jet assembly.

Referring to FIG. 2, as described above, this invention is intended to stimulate precise locations of a woman's genitalia, specifically the clitoris and the labia (these sensitive areas are collectively called "stimulation points" and are collectively referred to by numeral 37 in FIG. 2). To achieve this, according to the invention, a single, dedicated outlet nozzle 40 can be integrally formed with and located within base 24 of the integrally-formed seat, and is connected to outlet pipe 30 by way of conduit 42 so that water returning to tub 12 from water-flow controller 26 may selectively pass through conduit 42 and enter tub 12 through nozzle 40. Located within conduit 42 is a mechanical fluid valve 44 which is preferably controlled by an electromechanical device, such as an electric motor (not shown), a solenoid (not shown), or a servo actuator (not shown). Such electrically controlled mechanical fluid valves are commercially available, and are well known by those skilled in the art.

The electromechanical device controlling valve 44 is preferably electrically connected to system controller 34 so that the user may control the flow rate (and perhaps, independently, the amount of aeration) of fluid through conduit 42 and nozzle 40.

Nozzle 40 is preferably recessed within a pocket 46 formed within base 24 of the seat so that the user may not directly contact nozzle 40 and be injured. Alternately, nozzle 40 may be positioned within a bore (not shown) formed within base 24 so that nozzle 40 is again protected from direct contact, or disposed flush to the supporting surface 25 of base 24. Also, the bore (not shown) drilled or otherwise formed within base 24 of the seat may function, in itself as nozzle 40 and conduit 42 and include a flexible hose connection to valve 44 so that water may pass through valve 44 through the flexible hose and the bore directed at stimulating points 37 of a female user.

Nozzle 40 is preferably shaped to provide a straight flow of fluid from outlet pipe 30 to point of contact on the user's body. Nozzle 40 is preferably positioned immediately adjacent to the user's clitoris, when the female user is comfortably seated with her butt snugly positioned against supporting surface 25 of base 24 and her back reclined against backrest 22. Depending on the particular shape of the seat, nozzle 40 may discharge a stream of fluid along an axis A that intersects a vertical axis B by a predetermined angle C.

Again, depending on the structural details of a particular spa 10, angle C is preferably in the range of 0 arc degrees and 45 arc degrees, with a range of 0 and 30 degrees being preferred.

An important aspect of the invention is that nozzle 40 discharges a converged (or straight) flow of fluid against primarily the clitoris (or other specific stimulating points 37 of the female genitalia, listed above) of a seated female and that the discharged fluid flow automatically aligns with stimulation points 37 (e.g., FIGS. 1 and 2).

Tub 12 is preferably shaped so that the female user's legs may be comfortably supported in a splayed position to further encourage clitoral stimulation (or other stimulation points 37), preferably to the point of "climax".

Of course, various cushions may be formed (e.g., integrally formed) within the seat of tub 12 or otherwise provided so that the user may comfortably recline within tub 12, as shown in FIG. 1.

Tub 12 may be manufactured using any conventional process, using any conventional materials, such as blow-molded plastic, layered fiberglass, or cement.

In operation, a female user sits within tub 12 so that her butt is snugly received and supported by supporting surface 25 of base 24 and her back is reclined against backrest 22. Tub 12 is filled with, or already contains water. The user selectively turns on water-flow controller 26 using control panel 36 so that water flows from tub 12 through drain 32 and inlet pipe 28, through a filter 27, a pump 29, aerator 23, and a heater 31. As described above, the user may control the temperature or flow rate of the water discharged through outlet wall jets 33. When desired, the user may selectively open valve 44 (using control panel 36), so that a controlled amount of water (with or without aeration) is diverted from wall jets 33 and directed to the female user's clitoris (or other stimulating points 37). Nozzle 40 is already aligned so that water forced through conduit 42 immediately contacts and stimulates the female user's clitoris. The female user may shift slightly within the seat to adjust or "fine tune" the stimulating flow of water from nozzle 40.

Applicant has discovered that additional outlet nozzles located in the seat and generally directed to the female user's genitalia is not as effective as a single nozzle directing a single stream of fluid to a specific stimulation point of contact (e.g., the clitoris). Multiple streams of fluid, although enjoyable, tend to desensitize the primary tactile nerve receptors located at specific points of a female user's genitalia.

To provide additional stimulation, a pulsator (not shown) may be located within conduit 42 (or located elsewhere but in fluid communication with the fluid that is discharged from nozzle 40) so that water discharged from nozzle 40 is pulsed between different rates of flow (e.g., fast-slow-fast, or on-off-on).

According to another embodiment of the invention (shown in FIG. 1 on an opposing seat of tub 12, for clarity), a mechanical vibrator 50 is attached below base 24 so that as the user enjoys hydro-therapeutic stimulation from the circulating water located within tub 12, the user may further enjoy vibrational stimulation transmitted directly through base 24 of the seat. The intensity of the vibration is preferably controllable by the user through control panel 36.

What is claimed is:

1. A spa of the type including a tub for holding water and a female user, said female user having stimulation points, said spa comprising:

a seat for supporting said female user in a seated position, said seat having a generally horizontal portion and a rearwardly positioned seatback;

a circulation pump having an inlet connected to said tub for drawing water from said tub, and an outlet connected to said tub for discharging said drawn water back to said tub; and a discharge nozzle located within said tub and connected to said outlet, said discharge nozzle being located within said horizontal portion of said seat and being adapted to discharge water rearwardly with respect to said horizontal portion from said outlet directly to said stimulation points of said female user when said female user is seated within said seat.

2. The spa according to claim 1, further comprising a water heater for heating water located within said tub.

3. The spa according to claim 1, further comprising a water aerator in fluid communication with said outlet so that said discharged water includes aeration.

4. The spa according to claim 3, further comprising a controller for controlling the amount of aeration introduced to said discharged water.

5. The spa according to claim 1, wherein said discharge nozzle is formed integrally with said seat of said tub.

6. The spa according to claim 1, further comprising a filter assembly that filters said discharge water.

7. The spa according to claim 1, further comprising a vibration generator adjacent to said seat, said vibration generator being adapted to selectively transmit vibration energy through said seat to said female user seated within said seat to stimulate said stimulation points.

* * * * *